US009037007B2

(12) United States Patent
Nishikawa

(10) Patent No.: US 9,037,007 B2
(45) Date of Patent: May 19, 2015

(54) IMAGE FORMING APPARATUS AND TONER REMAINING AMOUNT CONTROL METHOD

(71) Applicant: KYOCERA DOCUMENT SOLUTIONS INC., Osaka (JP)

(72) Inventor: Shingo Nishikawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/075,660

(22) Filed: Nov. 8, 2013

(65) Prior Publication Data

US 2014/0133873 A1 May 15, 2014

(30) Foreign Application Priority Data

Nov. 14, 2012 (JP) ..... 2012-250211

(51) Int. Cl.
*G03G 15/08* (2006.01)
*G03G 15/00* (2006.01)

(52) U.S. Cl.
CPC ..... *G03G 15/0856* (2013.01); *G03G 15/0877* (2013.01); *G03G 15/556* (2013.01)

(58) Field of Classification Search
USPC ..... 399/27
See application file for complete search history.

(56) References Cited

U.S. PATENT DOCUMENTS

| | | | | |
|---|---|---|---|---|
| 6,347,198 | B1 * | 2/2002 | Yamamoto et al. | 399/27 |
| 7,330,673 | B2 * | 2/2008 | Eom | 399/24 |
| 7,382,991 | B2 * | 6/2008 | Choi | 399/27 |
| 7,421,217 | B2 * | 9/2008 | Sugita et al. | 399/27 |
| 8,155,540 | B2 * | 4/2012 | Bichkar | 399/27 |
| 8,625,145 | B1 * | 1/2014 | Moss et al. | 358/1.16 |
| 2005/0147422 | A1 * | 7/2005 | Ahn | 399/27 |
| 2008/0031644 | A1 * | 2/2008 | Kin et al. | 399/27 |
| 2010/0098441 | A1 * | 4/2010 | Miyazaki et al. | 399/27 |
| 2014/0133873 | A1 * | 5/2014 | Nishikawa | 399/27 |

FOREIGN PATENT DOCUMENTS

JP 2004-347931 A 12/2004

* cited by examiner

*Primary Examiner* — W B Perkey
(74) *Attorney, Agent, or Firm* — Studebaker & Brackett PC

(57) ABSTRACT

A dot-count calculation section counts the number of dots that are printed, and calculates an amount of toner consumed in a developing device (toner consumption amount). A toner supply amount calculation section calculates an amount of toner supplied to the developing device by the toner supply mechanism (toner supply amount). A cumulative toner supply amount holding section holds a cumulative toner supply amount. A correction toner supply amount calculation section calculates a used amount of the toner in the toner case (correction toner supply amount), based on the toner consumption amount and the toner supply amount. A cumulative toner supply amount updating section adds the correction toner supply amount and the cumulative toner supply amount, and stores a value resulting from the addition in the cumulative toner supply amount holding section, as a new cumulative toner supply amount.

8 Claims, 7 Drawing Sheets

901

| Toner remaining amount (%) | Factor B |
|---|---|
| 100~80 | 1 |
| 80~60 | 0. 9 |
| 60~40 | 0. 8 |
| 40~20 | 0. 8 |
| 20~10 | 0. 8 |
| 10~5 | 0. 7 |
| 5~0 | 0. 5 |

FIG. 9

1001

| Toner sensor output value | Number of rotations for supply (times) | Toner supply amount (mg) |
|---|---|---|
| 612 | 2. 8 | 64 |
| 587 | 2. 1 | 48 |
| 562 | 1. 4 | 32 |
| 537 | 0. 7 | 16 |
| 512 | 0 | 0 |

FIG. 10

1101

| Toner remaining amount (%) | Factor A |
|---|---|
| 100~80 | 0. 5 |
| 80~60 | 0. 5 |
| 60~40 | 0. 8 |
| 40~20 | 0. 8 |
| 20~10 | 0. 8 |
| 10~5 | 1 |
| 5~0 | 1 |

FIG. 11

IMAGE FORMING APPARATUS AND TONER REMAINING AMOUNT CONTROL METHOD

INCORPORATION BY REFERENCE

The present application claims priority under 35 U.S.C. §119 to Japanese Patent Application No. 2012-250211, filed Nov. 14, 2012. The contents of this application are incorporated herein by reference in their entirety.

BACKGROUND

The present disclosure relates to image forming apparatuses having a function to control a toner remaining amount for image formation and toner remaining amount control methods.

In recent years, an image forming apparatus capable of performing color printing has become more general. The image forming apparatus, for example, is a copier or a multifunction peripheral. This type of image forming apparatus realizes color printing by combining a plurality of recording agents. For example, the plurality of recording agents are toner having four colors: cyan (C), magenta (M), yellow (Y), and black (K). Many image forming apparatuses control the remaining amount of each recording agent. In addition, the image forming apparatus has a function to inform a user of a near-empty state. The near-empty state is a state in which the recording agent is running out and image formation will be impossible soon. A user directly operating the image forming apparatus is informed of the state by screen display, buzzer, and so on. In addition, in some cases, an administrator of the apparatus or the like that is not directly operating the image forming apparatus is notified by e-mail transmission to a specific destination that is previously designated and so on.

In controlling the remaining amount of recording agent as above, a dot-count method is often used for calculating the amount of recording agent consumption. The dot-count method is to count the number of dots printed on a transfer target such as paper, based on the image data entered into the image forming apparatus as a printing target. Then, the amount of recording agent consumption is calculated by multiplying the count value by the amount of the recording agent consumed for printing one dot. It should be noted that for an image forming apparatus that performs multi-tone printing (for example, 256 tones), a print having tones over a previously designated threshold, for example, is counted as dots.

In controlling the remaining amount of recording agent as described above, it is required to grasp the remaining amount of recording agent accurately so as to prevent a decrease in productivity of the image forming apparatus as well as allowing appropriate supply (replacement) of the recording agent. However, according to the dot-count method as described above, even multi-tone printing is binarized and counted. Therefore, this results in a state where the recording agent is used for printing that is not counted as dots, or a state where only a small amount of recording agent is consumed for the printing counted as dots, compared to the amount of the recording agent consumed for printing one dot as described above.

To prevent this, an image forming apparatus performs life management (toner remaining amount control) of a toner cartridge, based on the dot count and the drive time of a developing roller included in a developing device. The developing device forms a toner image by attaching toner to an electronic latent image formed on a photosensitive drum. In addition, an image forming apparatus counts the number of dots by classifying the dots, according to the printing pattern, into groups such as the dots not less than a threshold, four consecutive dots, and isolated dots, and calculates the amount of toner consumption based on these count values.

SUMMARY

To achieve the above objective, an image forming apparatus according to the present disclosure uses a technical means as follows. In other words, the image forming apparatus according to the present disclosure includes: a toner case, a developing device, a toner sensor, a toner supply mechanism, a dot-count calculation section, a toner supply amount calculation section, a cumulative toner supply amount holding section, a correction toner supply amount calculation section, and a cumulative toner supply amount updating section. The toner case stores toner. The developing device attaches toner to an electrostatic latent image formed on an image carrier, so as to form a toner image on the image carrier. The toner sensor detects an amount of the toner in the developing device. The toner supply mechanism supplies the developing device with the toner stored in the toner case, based on an output value of the toner sensor. The dot-count calculation section counts, based on the image data, the number of dots printed on a transfer target, and calculates, based on a count value, a toner consumption amount that is an amount of the toner consumed in the developing device. The toner supply amount calculation section calculates a toner supply amount that is an amount of the toner supplied by the toner supply mechanism from the toner case to the developing device. The cumulative toner supply amount holding section holds a cumulative toner supply amount that is a cumulative amount of the toner supplied from a point when the use of the toner in the toner case is started. The correction toner supply amount calculation section calculates a correction toner supply amount that is a used amount of the toner in the toner case, based on the toner consumption amount and the toner supply amount, the toner consumption amount being calculated by the dot-count calculation section, and the toner supply amount being calculated by the toner supply amount calculation section. The cumulative toner supply amount updating section adds the correction toner supply amount and the cumulative toner supply amount, and stores a value resulting from the addition as a new cumulative toner supply amount in the cumulative toner supply amount holding section, the correction toner supply amount being calculated by the correction toner supply amount calculation section, and the cumulative toner supply amount being held by the cumulative toner supply amount holding section.

On the other hand, in another aspect, the present disclosure allows providing a toner remaining amount control method that is applied to an image forming apparatus including the toner case, the developing device, the toner sensor, and the toner supply mechanism as described above. The toner remaining amount control method includes: counting, based on the image data, the number of dots printed on a transfer target, and calculating, based on a count value, a toner consumption amount that is an amount of the toner consumed in the developing device; calculating a toner supply amount that is an amount of the toner supplied by the toner supply mechanism from the toner case to the developing device; calculating a correction toner supply amount based on the calculated toner consumption amount and the calculated toner supply amount, the correction toner supply amount being a used amount of the toner in the toner case; adding the calculated correction toner supply amount and a cumulative toner supply amount held at a time of calculating the correction toner supply amount; and holding a value resulting from the addition as a new cumulative toner supply amount. The cumulative toner supply amount is a cumulative amount of the toner supplied from a point when the use of the toner in the toner case is started to a point when the correction toner supply amount is calculated.

BRIEF DESCRIPTION OF THE DRAWINGS

FIG. 9 is a diagram showing an example of a factor table held by a toner supply amount calculation section of the multifunction peripheral according to an embodiment of the present disclosure.

FIG. 10 is a diagram showing a relationship between an output value of a toner sensor in a toner supply mechanism, the number of rotations, and the toner supply amount in the multifunction peripheral according to an embodiment of the present disclosure.

FIG. 11 is a diagram showing an example of a factor table held by a correction toner supply amount calculation section of the multifunction peripheral according to an embodiment of the present disclosure.

DETAILED DESCRIPTION

The following describes further details of embodiments according to the present disclosure with reference to the drawings. The following describes the present disclosure embodied as a digital multifunction peripheral (an example of the image forming apparatus) having a function to control the toner remaining amount.

Brief Description of the Drawings

Figure 1:
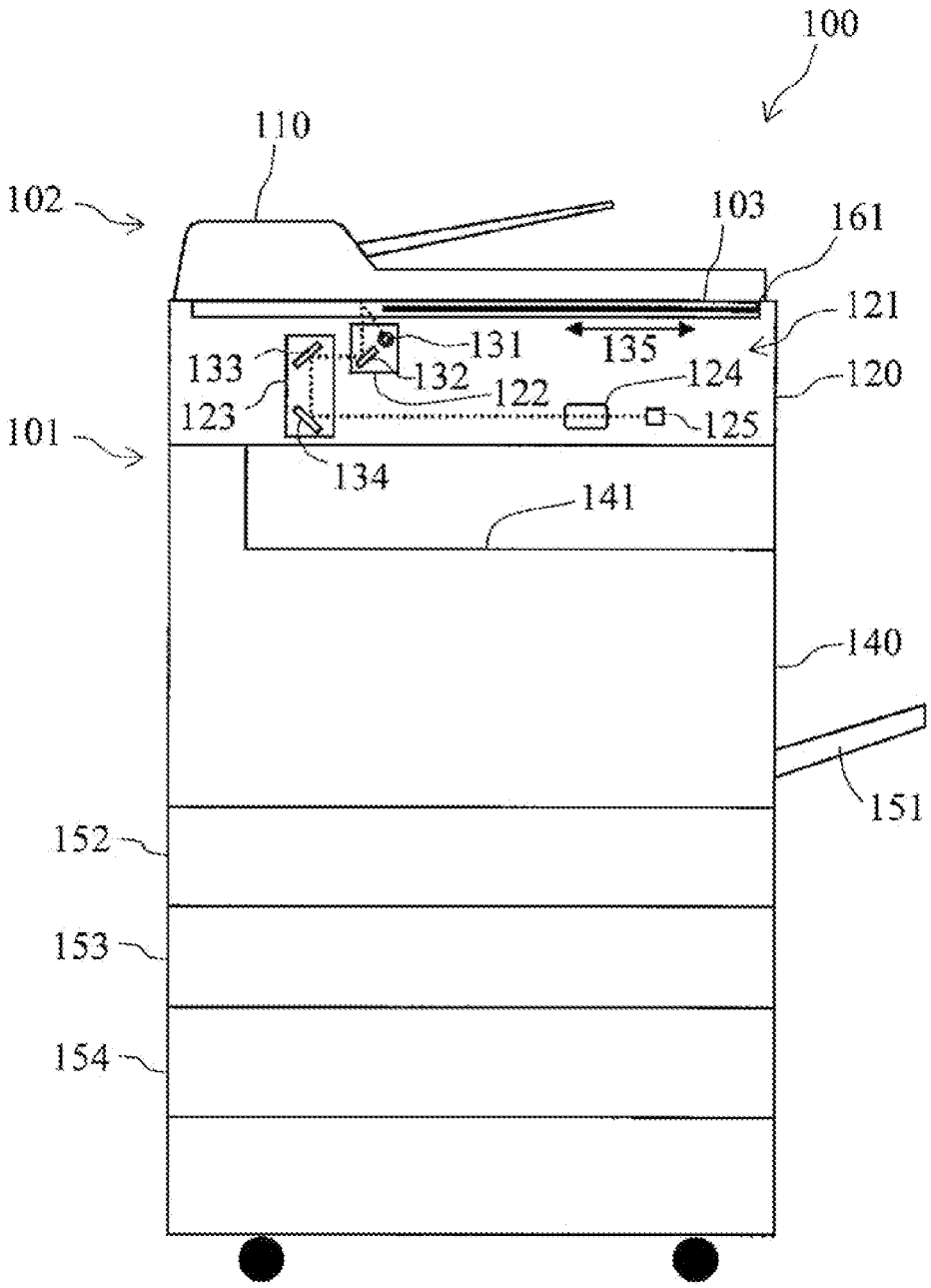
FIG. 1 is a schematic view of an overall configuration of a multifunction peripheral according to an embodiment of the present disclosure.

FIG. 1 is a schematic view showing an example of an overall configuration of a multifunction peripheral 100, which is a digital multifunction peripheral, in the present embodiment. As shown in FIG. 1, the multifunction peripheral 100 includes a body 101 and a platen cover 102. The body 101 includes an image reading section 120 and an image forming section 140. The platen cover 102 is attached onto the body 101. On a top surface of the body 101, a platen 103 is provided. The platen 103 is made of a transparent board like contact glass. The platen 103 is caused to be in an exposed state or in an unexposed state by opening and closing of the platen cover 102.

In addition, the platen cover 102 includes a document feeder 110. It should be noted that an operation panel 161 is provided in a front surface of the multifunction peripheral 100. A user gives an instruction to start copy and other instructions to the multifunction peripheral 100 through operating on the operation panel 161. The user also checks the state and the setting of the multifunction peripheral 100, using the operation panel 161.

Under the platen 103, the image reading section 120 is provided. The image reading section 120 reads an image from a document using a scanning optical system 121, and generates digital data (image data) of the image. The document is placed on the platen 103 or the document feeder 110. The scanning optical system 121 includes a first carriage 122, a second carriage 123, a condensing lens 124, and a line image sensor 125. The first carriage 122 includes a light source 131 having a linear shape and a mirror 132 having a linear shape. The second carriage 123 includes a mirror 133 and a mirror 134.

The light source 131 illuminates the document. The mirror 132, the mirror 133, and the mirror 134 guide the reflected light from the document to the condensing lens 124. The condensing lens 124 forms an optical image of the document onto a light-receiving surface of the line image sensor 125. In the scanning optical system 121, the first carriage 122 and the second carriage 123 are provided to be reciprocally movable in a sub scanning direction 135. The first carriage 122 and the second carriage 123 move in the sub scanning direction 135. Then, the line image sensor 125 reads the image of the document placed on the platen 103.

In reading the image of the document placed on the document feeder 110, the image reading section 120 temporarily sets the first carriage 122 and the second carriage 123 to an image reading position. Then, the image reading section 120 reads, through the line image sensor 125, the image of the document passing the image reading position. The line image sensor 125 generates image data corresponding to each color from among, for example, red (R), green (G), and blue (B), from the optical image formed on the light-receiving surface. The image data, thus generated, is printed onto paper by the image forming section 140. It is also possible to transmit the generated image data to another device (not shown) through a network by a network interface that is not shown.

The image forming section 140 prints out, on paper, the image data generated by the image reading section 120 or the image data received, via the network interface, from another device (not shown) connected to the network and so on (image formation).

Figure 2:
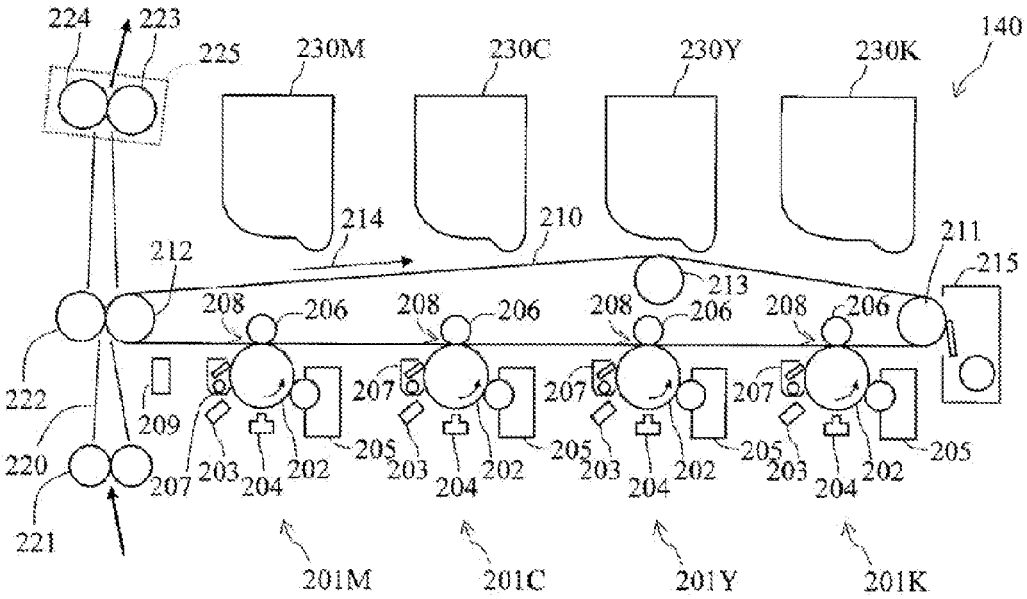
FIG. 2 is a schematic view of a configuration of an image forming section in the multifunction peripheral according to an embodiment of the present disclosure.

FIG. 2 is a schematic view showing an example of the configuration of the image forming section 140. The image forming section 140 is in what is called a tandem system. As shown in FIG. 2, the image forming section 140 includes: a transfer belt 210 that is endless in shape, an image forming unit 201 C, an image forming unit 201M, an image forming unit 201Y, and an image forming unit 201K.

The image forming unit 201C, the image forming unit 201M, the image forming unit 201Y, and the image forming unit 201K are arranged in parallel along the transfer belt 210. The image forming unit 201C forms a toner image in cyan (C). The image forming unit 201M forms a toner image in magenta (M). The image forming unit 201Y forms a toner image in yellow (Y). The image forming unit 201K forms a toner image in black (K).

The transfer belt 210 is wound around a drive roller 211, a driven roller 212, and a driven roller 213. The driven roller 213 is biased from the inside toward the outside of the transfer belt 210, thereby giving tension to the transfer belt 210. The transfer belt 210 rotates, driven by the drive roller 211, in a direction indicated by an arrow 214.

Each of the image forming unit 201C, the image forming unit 201M, the image forming unit 201 Y, and the image forming unit 201K includes a photosensitive drum 202 that is an image carrier. The photosensitive drum 202 rotates in one direction at a constant rate. Around the photosensitive drum 202, in order from upstream of the rotational direction, provided are: a charger 203, an exposure device 204, a developing device 205, a transfer roller 206, a cleaning device 207, and so on.

The charger 203 uniformly charges a surface (image carrier surface) of the photosensitive drum 202. The exposure device 204 irradiates with light, according to the image data, the surface of the photosensitive drum 202 that is uniformly charged, thus forming an electrostatic latent image on the photosensitive drum 202. The developing device 205 attaches toner to the electrostatic latent image, thus forming a toner image on the photosensitive drum 202. The toner image is transferred onto the transfer belt 210, in a primary transfer section 208 provided between the transfer roller 206 and the photosensitive drum 202. The cleaning device 207 takes the residual toner off the surface of the photosensitive drum 202 after the transfer performed by the transfer roller 206.

In the present embodiment, the surface of the photosensitive drum 202, which is irradiated with exposure light, loses charge. In addition, the toner has been provided with a charge having the same polarity as the charge polarity of the photosensitive drum 202. Thus, in the photosensitive drum 202, the toner does not adhere to a non-exposed area that is not irradiated with exposure light, whereas the toner adheres to an exposed area that is irradiated with exposure light. To the transfer roller 206, a voltage having a reverse polarity to the photosensitive drum 202 (reverse polarity to the toner) is applied. Accordingly, the toner attached to the exposed area is transferred onto the transfer belt 210.

In the present embodiment, although not particularly limited to the following, in order from upstream of the rotational direction of the transfer belt 210, provided are: the image forming unit 201K, the image forming unit 201Y, the image forming unit 201C, and the image forming unit 201M. In this order, the image forming units 201K, 201Y, 201C, and 201M transfer the toner images in the K, Y, C, and M colors on the transfer belt 210, respectively. By controlling the timing of transfer of the toner image in each color, the toner image in each color is sequentially superimposed on the transfer belt 210, so that a color toner image on the transfer belt 210 is formed.

It should be noted that the image data in RGB format is converted into image data in CMYK format. Then, the image data in the C color is entered into the exposure device 204 of the image forming unit 201C, the image data in the M color is entered into the exposure device 204 of the image forming unit 201M, the image data in the Y color is entered into the exposure device 204 of the image forming unit 201Y, and the image data in the K color is entered into the exposure device 204 of the image forming unit 201K.

In addition, the image forming unit 201 C includes a toner container 230C, the image forming unit 201M includes a toner container 230M, the image forming unit 201Y includes a toner container 230Y, and the image forming unit 201K includes a toner container 230K. The toner container 230C supplies toner to the developing device 205 of the image forming unit 201C, the toner container 230M supplies toner to the developing device 205 of the image forming unit 201M, the toner container 230Y supplies toner to the developing device 205 of the image forming unit 201Y, and the toner container 230K supplies toner to the developing device 205 of the image forming unit 201K. Each of the toner containers 230C, 230M, 230Y, and 230K is detachably attached to a corresponding one of the developing devices 205.

Figure 3:
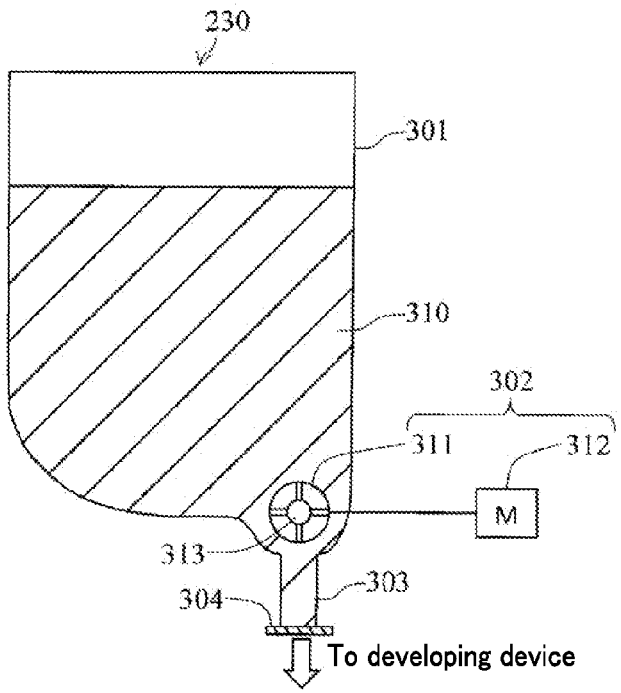
FIG. 3 is a schematic view of a configuration of a toner container in the multifunction peripheral according to an embodiment of the present disclosure.

FIG. 3 is a schematic cross-sectional view showing a configuration of the toner container 230. It should be noted that the toner containers 230C, 230M, 230Y, and 230K have the same configuration and therefore are described here irrespective of color. The toner containers 230C, 230M, 230Y, and 230K are to be collectively called the "toner container 230". As shown in FIG. 3, the toner container 230 includes: a toner case 301 for storing unused toner 310, a toner supply mechanism 302, a supply port 303, and a shutter member 304.

The supply port 303 is provided at one end of the bottom of the toner case 301 (for example, in an inner part of the multifunction peripheral 100 in the state shown in FIG. 1). The supply port 303 is provided in a state opposite to a toner conveyance section of the developing device 205 that is to be described later.

The shutter member 304 is provided between the supply port 303 and the toner conveyance section of the developing device 205. The shutter member 304 switches between an open state and a closed state of the supply port 303. The open state is a state in which the toner case 301 and the developing device 205 are communicated with each other. In other words, the open state is a state in which the toner 310 can be supplied from the toner case 301 to the developing device 205 through the supply port 303. In addition, the closed state is a state in which the toner case 301 and the developing device 205 are separate from each other. In other words, the closed state is a state in which the toner 310 cannot be supplied from the toner case 301 to the developing device 205 through the supply port 303.

The toner supply mechanism 302 supplies the toner 310 stored in the toner case 301 to the developing device 205. Although not particularly limited to the following, in the present embodiment, the toner supply mechanism 302 includes a toner conveyance member 311 and a drive motor 312.

The toner conveyance member 311 has a rotational axis 313 disposed in a direction perpendicular to the plane of paper in FIG. 3. The toner conveyance member 311 includes a screw that is formed around the rotational axis 313. The screw is formed in a spiral manner at a constant pitch in an axis direction of the rotational axis 313. The toner conveyance member 311 is provided at a position opposite to the supply port 303.

The drive motor 312 rotationally drives the toner conveyance member 311 around the rotational axis 313. When the toner conveyance member 311 is rotationally driven by the drive motor 312, the toner 310 is carried toward the supply port 303. In this state, when the shutter member 304 is put into an open state, the toner 310 in the toner case 301 is supplied to the developing device 205 through the supply port 303. The drive motor 312 includes, but not limited to, a stepping motor. Thus, this allows accurate control of the number of rotations of the toner conveyance member 311.

Figure 4A:
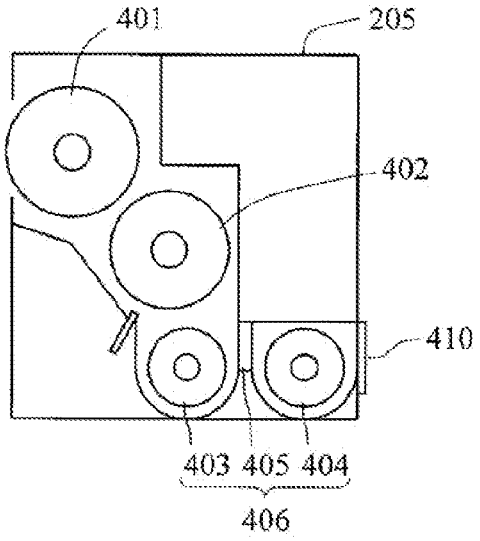
FIG. 4A is a schematic view of a configuration of a developing device in the multifunction peripheral according to an embodiment of the present disclosure.
Figure 4B:
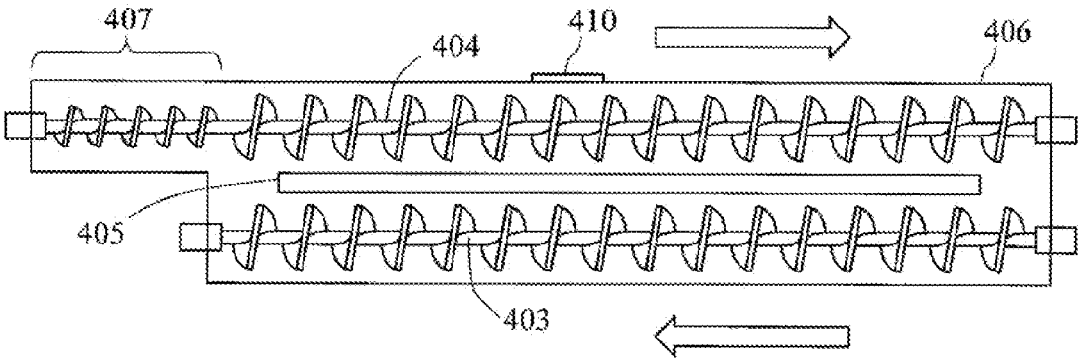
FIG. 4B is a schematic plan view of a toner stirring section of the developing device in the multifunction peripheral according to the embodiment of the present disclosure.

In addition, FIG. 4 is a schematic view showing a configuration of the developing device 205. It should be noted that the developing device 205 included in each of the image forming units 201K, 201Y, 201C, and 201M has the same configuration and therefore are described here irrespective of color. FIG. 4A is a schematic view showing the configuration of the developing device 205 as viewed from the same direction as in FIG. 2. FIG. 4B is a schematic plan view showing a toner stirring section 406 of the developing device 205.

As shown in FIG. 4A, the developing device 205 includes a developing roller 401, a magnetic roller 402, a stirring screw 403, a stirring screw 404, a partition wall 405, and a toner sensor 410. Each of the developing roller 401, the magnetic roller 402, the stirring screw 403, and the stirring screw 404 has a rotational axis parallel to the photosensitive drum 202. The developing device 205 contains, inside, a two component developer including toner (non-magnetic toner) and a magnetic carrier.

As shown in FIG. 4B, each of the stirring screws 403 and 404 includes a screw that is formed around a rotational axis. The screw is formed in a spiral manner at a constant pitch along the axis direction of the rotational axis. The stirring screws 403 and 404 are provided opposite to each other via the partition wall 405.

The stirring screws 403 and 404 and the partition wall 405 are included in the toner stirring section 406. By rotating the stirring screws 403 and 404 around the rotational axis, the toner and the magnetic carrier in the developing device 205 are caused to circulate within the toner stirring section 406. The circulation causes a collision between the toner and the magnetic carrier. The friction generated at the time of collision gives the toner a charge having the same polarity as the charge polarity of the photosensitive drum 202.

It should be noted that in the example shown in FIG. 4B, the rotation of the stirring screw 404 causes the toner and the magnetic carrier to move in the right direction. In addition, the rotation of the stirring screw 403 causes the toner and the magnetic carrier to move in the left direction.

As shown in FIG. 4B, in the present embodiment, a toner conveyance section 407 having an opening in an upper side is provided at one end of the stirring screw 404. The toner conveyance section 407 is disposed opposite to the supply port 303 of the toner container 230. The toner is carried into the toner conveyance section 407 through the supply port 303. Then, the toner is guided into the toner stirring section 406 by the rotation of the stirring screw 404, and circulates within the toner stirring section 406. It should be noted that the stirring screws 403 and 404 are rotationally driven in a predetermined cycle (for example, 150 ms/rotation) during the operation of the developing device 205 (that is, during printing).

The magnetic roller 402 has a plurality of magnetic poles in a circumferential direction thereof, forming a magnetic brush on the surface thereof. The magnetic brush includes a toner and a magnetic carrier. The developing roller 401 is disposed opposite to the magnetic roller 402. The surface of the developing roller 401 is rubbed against the magnetic brush formed on the surface of the magnetic roller 402. As a result, a thin toner layer is formed on the surface of the developing roller 401. The developing roller 401 develops the electrostatic latent image on the surface of the photosensitive drum 202 by the thin toner layer.

The toner sensor 410 detects the amount of the toner in the developing device 205 (toner stirring section 406). In the present embodiment, as shown in FIG. 4A and FIG. 4B, the toner sensor 410 is disposed in the center in a longer direction of a side wall that is closest to the stirring screw 404 among side walls of the toner stirring section 406.

For the toner sensor 410, for example, an optical sensor or a piezoelectric sensor can be used. For example, if the toner sensor 410 is an optical sensor of a transmission type, the sensor includes a light-emitting section and a light-receiving section. The light-emitting section and the light-receiving section are provided such that an optical path from the light-emitting section to the light-receiving section crosses a conveyance path in which the toner is carried by the stiffing screw 404. This configuration shows that: the larger the amount of light received by the light-receiving section (the larger the sensor output value), the smaller the amount of the toner, and the smaller the amount of the received light (the smaller the sensor output value), the larger the amount of the toner. The toner supply mechanism 302 supplies the toner 310 stored in the toner case 301 to the developing device 205, based on the output value of the toner sensor 410.

To return to FIG. 1 and FIG. 2, the image forming section 140 feeds paper from a manual feed tray 151, a paper feed cassette 152, a paper feed cassette 153, a paper feed cassette 154, or the like, to a secondary transfer section via a conveyance path 220. The secondary transfer section is formed between the transfer belt 210 and a secondary transfer roller 222. In each of the manual feed tray 151, the paper feed cassette 152, the paper feed cassette 153, and the paper feed cassette 154, paper of various sizes can be placed or stored.

The image forming section 140 selects paper designated by the user or paper according to the document size that is automatically detected. Then, the image forming section 140 feeds the selected paper, by a feed roller, from the manual feed tray 151, the paper feed cassette 152, the paper feed cassette 153, or the paper feed cassette 154. The paper, which is fed, is carried to the secondary transfer section by the conveyance roller and a resist roller 221.

The paper onto which the toner image is transferred is carried to a fixing device 225. The fixing device 225 includes a fixing roller 223 including a built-in heater and a pressure roller 224, and fixes the toner image onto the paper by heat and pressure. The image forming section 140 ejects the paper that has passed through the fixing device 225, into an exit tray 141. After the secondary transfer, the residual toner on the transfer belt 210 is removed by the cleaning device 215. The cleaning device 215 is disposed in the downstream of the secondary transfer section and in the upstream of the image forming unit 201K.

Figure 5:
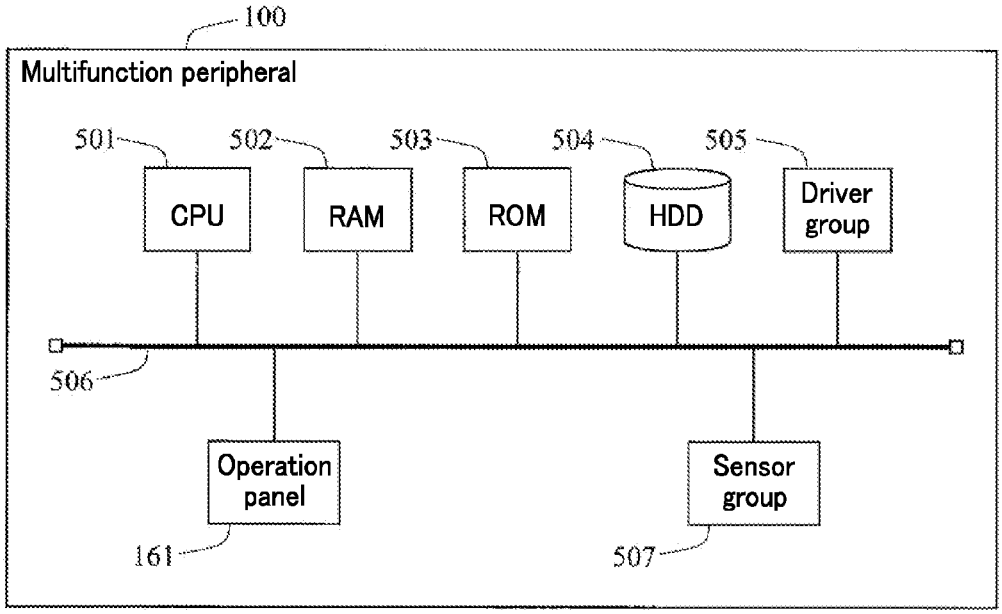
FIG. 5 is a diagram showing a hardware configuration of the multifunction peripheral according to an embodiment of the present disclosure.

FIG. 5 is a diagram showing a hardware configuration of a control system of the multifunction peripheral 100. In the multifunction peripheral 100 according to the present embodiment, a central processing unit (CPU) 501, a random access memory (RAM) 502, a read-only memory (ROM) 503, a hard disk drive (HDD) 504, and a driver group 505 are connected to each other through an internal bus 506. The driver group 505 includes a plurality of drivers that correspond to a plurality of drive sections in the document feeder 110, the image reading section 120, and the image forming section 140.

The ROM 503, the HDD 504, and so on store control programs. The CPU 501 controls the multifunction peripheral 100 according to an instruction from the control program. For example, the CPU 501 uses the RAM 502 as a work area. Then, the CPU 501 controls the operation of the respective drive sections described above by providing and receiving the data and instructions to and from the driver group 505. In addition, the HDD 504 is also used for accumulating the image data obtained by the image reading section 120 as well as the image data received from another device through the network and so on.

To the internal bus 506, the operation panel 161 and a sensor group 507 are also connected. The operation panel 161 receives a user operation. Then, the operation panel 161 provides the CPU 501 with a signal based on the user operation.

In addition, the operation panel 161 displays an operation screen through which the user enters an instruction, according to the control signal from the CPU 501, into the display included in the operation panel 161 itself.

In addition, the sensor group 507 includes various types of sensors such as: an opening and closing detection sensor, a document detection sensor, a temperature sensor, and a detection sensor. The opening and closing detection sensor detects the opening and closing of the platen cover 102. The document detection sensor detects the document on the platen 103. The temperature sensor detects the temperature of the fixing device 225. The detection sensor detects the paper or document that is carried. The CPU 501 realizes each means (functional block) described below by executing a control program stored on the ROM 503, for example, and also controls the operation of each means according to signals from these sensors.

Figure 6:
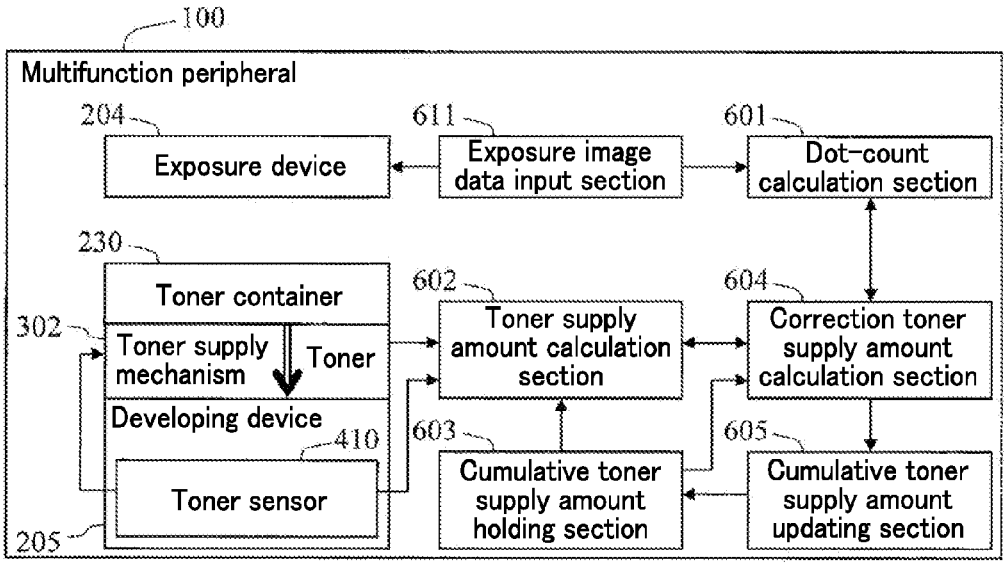
FIG. 6 is a functional block diagram showing the multifunction peripheral according to an embodiment of the present disclosure.

FIG. 6 is a functional block diagram of the multifunction peripheral 100 according to the present embodiment. As shown in FIG. 6, the multifunction peripheral 100 according to the present embodiment includes: a dot-count calculation section 601, a toner supply amount calculation section 602, a cumulative toner supply amount holding section 603, a correction toner supply amount calculation section 604, and a cumulative toner supply amount updating section 605.

The dot-count calculation section 601 counts, based on the image data, the number of the dots printed on the transfer target. Then, the dot-count calculation section 601 calculates, based on the count value, the toner consumption amount. The toner consumption amount is an amount of the toner consumed in the developing device 205. Although not particularly limited to the following, in the multifunction peripheral 100, the image data that is to be entered into each exposure device 204 is generated by an exposure image data input section 611. The exposure image data input section 611 converts, for example, the image data in RGB format into the image data in CMYK format, and holds the image data in the C color, the image data in the M color, the image data in the Y color, and the image data in the K color. In the present embodiment, the RAM 502 functions as an area for holding the image data for the exposure image data input section 611. Then the exposure image data input section 611 enters: the image data in the C color into the exposure device 204 of the image forming unit 201C; the image data in the M color into the exposure device 204 of the image forming unit 201M; the image data in the Y color into the exposure device 204 of the image forming unit 201Y; and the image data in the K color into the exposure device 204 of the image forming unit 201K.

The dot-count calculation section 601 counts the number of the dots printed on the transfer target, based on the image data entered from the exposure image data input section 611 into the exposure device 204 of each of the image forming units 201C, 201M, 201Y, and 201K (or each piece of the image data held by the exposure image data input section 611) (dot count). When the image data is the multi-tone image data, such counting can be realized by, as publicly known, counting pixels having predetermined tones (for example, 127 to 255 in the case of 256 tones from 0 to 255) in the image data. The dot-count calculation section 601 calculates the toner consumption amount by multiplying the count value by a previously designated amount of toner consumed for printing one dot. The toner consumption amount is calculated for each of the C, M, Y, and K colors.

It should be noted that as described below, the dot-count calculation section 601 accumulates and holds the calculated toner consumption amount until an arrival of previously designated timing for calculating the correction toner supply amount. Then, when the timing for calculating the correction toner supply amount arrives, the dot-count calculation section 601 resets (sets to zero) the toner consumption amount that has been accumulated up to the point when the timing for calculating the correction toner supply amount arrives, according to the instruction from the correction toner supply amount calculation section 604.

In the present embodiment, although not particularly limited to the following, the timing for calculating the correction toner supply amount is set to points in time when printing of a predetermined number of pages (for example, 10 pages) is completed in one printing job, and when all the printing included in the one printing job is completed. In other words, in the case of printing not more than 10 pages in printing onto the transfer target such as paper in one printing job, the timing for calculating the correction toner supply amount is the point when all the printing job is completed. In addition, when the number of pages to be printed in the printing job is, for example, 25 pages, the timing for calculating the correction toner supply amount is at different time points: when the printing onto the tenth page is completed; when the printing onto the twentieth page is completed; and when all the printing is completed.

The toner supply amount calculation section 602 calculates a toner supply amount. The toner supply amount is an amount of the toner supplied by the toner supply mechanism 302 from the toner case 301 to the developing device 205. The toner supply amount is calculated for each of the C color, the M color, the Y color, and the K color. As described above, in the present embodiment, the toner supply mechanism 302 includes the toner conveyance member 311 and the drive motor 312. Then, the number of rotations of the toner conveyance member 311 is strictly controlled by the drive motor 312. With this configuration, it is possible to grasp the number of rotations of the toner conveyance member 311 by counting the number of drive pulses entered into the drive motor 312.

The toner supply amount calculation section 602 obtains the number of rotations of the toner conveyance member 311, based on the drive pulse. Then, the toner supply amount calculation section 602 calculates the toner supply amount (that is the amount of the toner supplied by the toner supply mechanism 302 from the toner case 301 to the developing device 205), by multiplying the number of rotations of the toner conveyance member 311 by the amount of the toner carried during one rotation of the toner conveyance member 311.

In addition, the toner supply amount calculation section 602, as with the dot-count calculation section 601, accumulates and holds the calculated toner supply amount up to the point when the previously designated timing for calculating the correction toner supply amount arrives. Then, when the timing for calculating the correction toner supply amount arrives, the toner supply amount calculation section 602 resets (sets to zero) the toner supply amount that has been accumulated up to the point when the timing for calculating the correction toner supply amount arrives, according to the instruction from the correction toner supply amount calculation section 604.

The cumulative toner supply amount holding section 603 holds the cumulative toner supply amount. The cumulative toner supply amount is a cumulative amount of the toner supplied from the point when the use of the toner in the toner case 301 is started. In the present embodiment, although not limited to the following, the HDD 504 functions as the cumulative toner supply amount holding section 603.

The correction toner supply amount calculation section 604 calculates the correction toner supply amount, based on the toner consumption amount calculated by the dot-count calculation section 601 and the toner supply amount calculated by the toner supply amount calculation section 602. The correction toner supply amount is a used amount of the toner in the toner case 301. The correction toner supply amount calculation section 604 calculates the correction toner supply amount with the timing for calculating the correction toner supply amount as described above.

Although not particularly limited to the following, the present embodiment, as described in detail below, the correction toner supply amount calculation section 604 calculates the correction toner supply amount during a predetermined time (hereinafter referred to as the "predetermined time PT"), based on the toner consumption amount (cumulative value) calculated by the dot-count calculation section 601 during the predetermined time PT, the toner supply amount (cumulative value) calculated by the toner supply amount calculation section 602 during the predetermined time PT, and the toner remaining amount. The toner remaining amount is the amount of toner remaining in the toner case 301, which is calculated from the cumulative toner supply amount held by the cumulative toner supply amount holding section 603. The predetermined time PT is a period of time from previous timing for calculating the correction toner supply amount (previous reset) up to the arrival of the timing for calculating the correction toner supply amount.

According to this configuration, it is possible to reflect a dependency of the amount of toner remaining in the toner case 301 in the toner supply amount (the amount of the toner supplied from the toner case 301 to the developing device 205), thus allowing more accurately grasping the amount of toner remaining in the toner case 301.

In addition, in the present embodiment, the toner supply amount calculation section 602 calculates not only the motion quantity (here, the number of rotations) of the toner supply mechanism 302 during the predetermined time PT, but also the toner supply amount based on the output value of the toner sensor 410 (the amount of the toner supplied by the toner supply mechanism 302, from the toner case 301 to the developing device 205) (to be hereinafter described). As a result, it is possible to calculate the toner supply amount more accurately.

The cumulative toner supply amount updating section 605 adds the correction toner supply amount calculated by the correction toner supply amount calculation section 604 and the cumulative toner supply amount held by the cumulative toner supply amount holding section 603. Then, the cumulative toner supply amount updating section 605 stores, in the cumulative toner supply amount holding section 603, a value resulting from the addition as a new cumulative toner supply amount.

Figure 7:
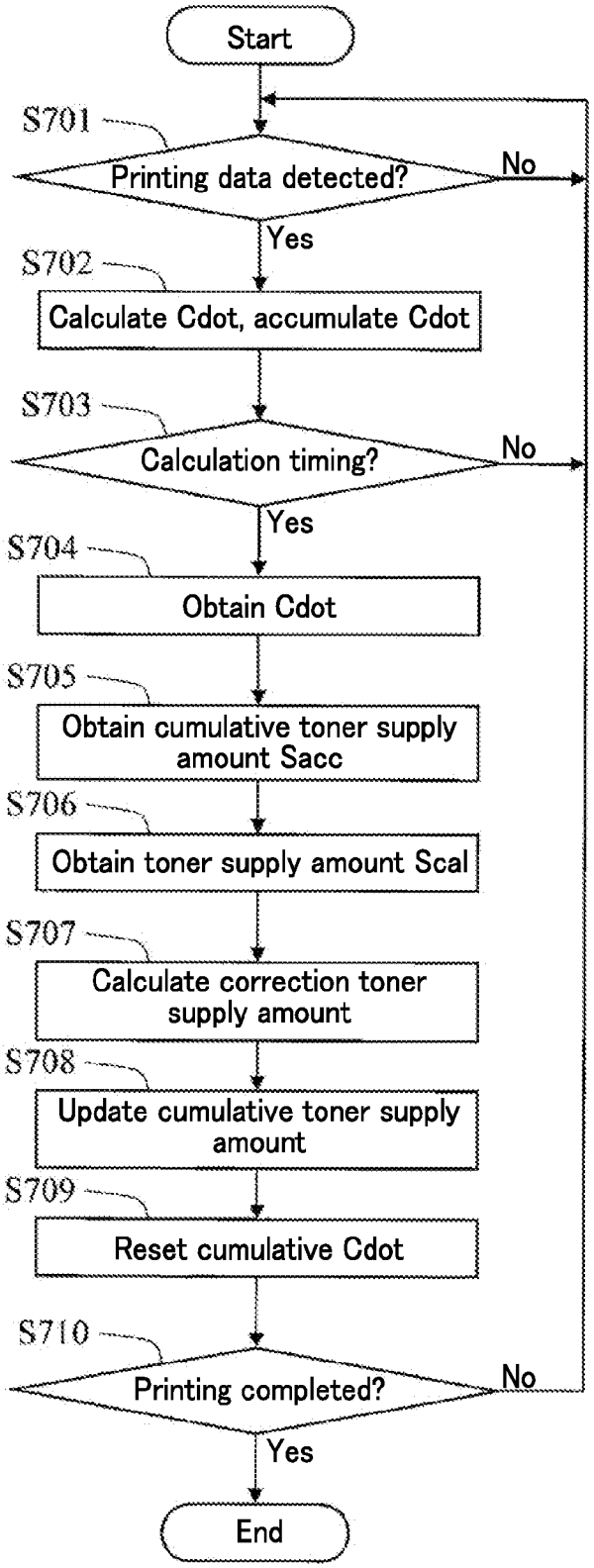
FIG. 7 is a flowchart showing an example of a correction toner supply amount calculation procedure performed by the multifunction peripheral according to an embodiment of the present disclosure.

FIG. 7 is a flowchart showing an example of a correction toner supply amount calculation procedure performed by the multifunction peripheral 100. The procedure, for example, is started with, as a trigger, starting of print processing in the image forming section 140, which is started when a printing job is entered into the multifunction peripheral 100, and so on.

When the procedure starts, the dot-count calculation section 601 stands by until the image data is generated in the exposure image data input section 611 (or until the image data is output from the exposure image data input section 611) (No in Step S701). The dot-count calculation section 601, upon detecting the image data (printing data) to be printed out, calculates a toner consumption amount Cdot based on the dot count (Yes in Step S701, and Step S702). As described above, the toner consumption amount Cdot, thus calculated, is accumulated up to the arrival of the timing for calculating the correction toner supply amount (No in Step S703, Yes in Step S701, and Step S702).

After the processing in Step S702, when the number of printed pages reaches a previously designated number or when all the printing is completed, and when the timing for calculating the correction toner supply amount arrives (Yes in Step S703), the correction toner supply amount calculation section 604 obtains the toner consumption amount Cdot (a cumulative value from the previous reset up to the arrival of the timing for calculating the correction toner supply amount) from the dot-count calculation section 601 (Step S704). In addition, the correction toner supply amount calculation section 604 obtains a cumulative toner supply amount Sacc from the cumulative toner supply amount holding section 603 (Step S705). Furthermore, the correction toner supply amount calculation section 604 obtains a toner supply amount Scal (a cumulative value from the previous reset up to the arrival of the timing for calculating the correction toner supply amount) from the toner supply amount calculation section 602 (Step S706).

Figure 8:
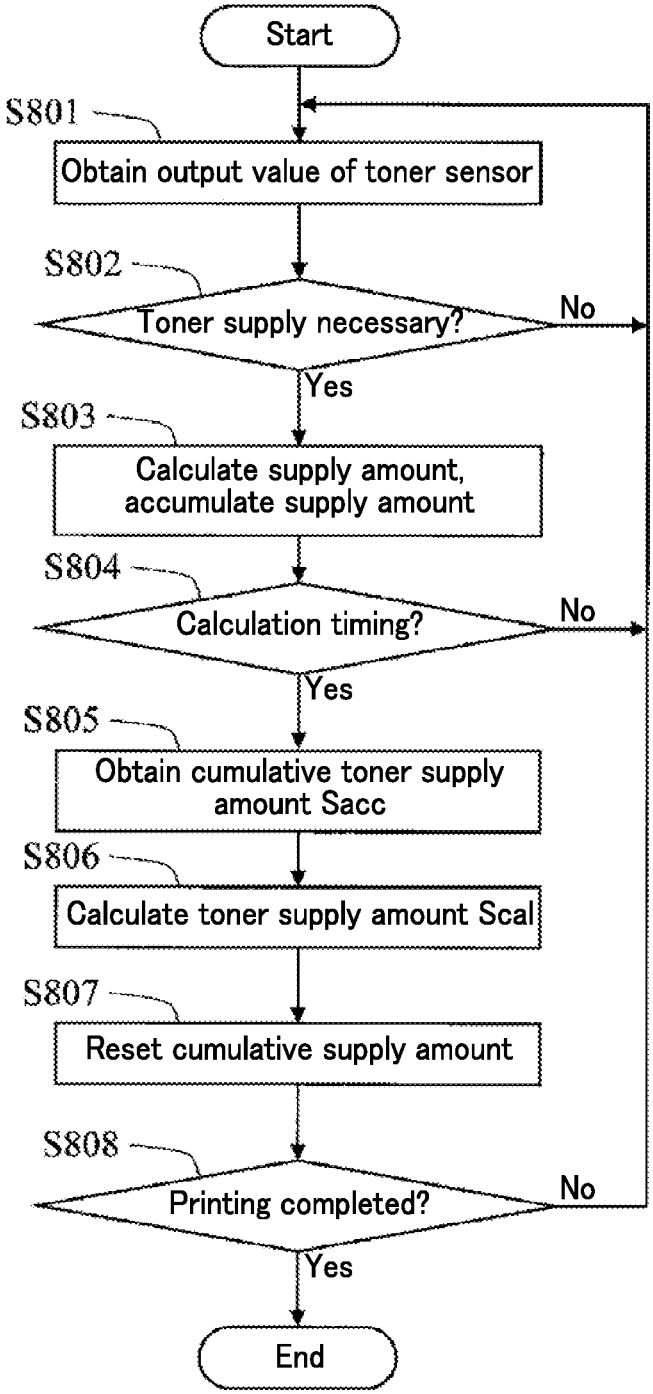
FIG. 8 is a flowchart showing an example of a toner supply amount calculation procedure performed by the multifunction peripheral according to an embodiment of the present disclosure.

Here described is calculation of the toner supply amount Scal that is performed by the toner supply amount calculation section 602. FIG. 8 is a flowchart showing an example of the toner supply amount calculation procedure performed by the toner supply amount calculation section 602. The procedure is started with, for example, starting of print processing in the image forming section 140 as a trigger.

When the procedure is started, the toner supply mechanism 302 obtains an output value of the toner sensor 410 in a predetermined sampling cycle (for example, a cycle of one rotation of the stirring screw 403 and the stirring screw 404) (Step S801). Then, the toner supply mechanism 302 compares the obtained output value of the toner sensor 410 and a reference value that is previously designated, and determines whether or not toner supply is necessary (Step S802). In present embodiment, although not particularly limited, a range of output values of the toner sensor 410 includes 1024 levels from 0 to 1023, and the reference value is set to 512.

In addition, since in the present embodiment, as described above, an optical sensor is adopted for the toner sensor 410, when the output value of the toner sensor 410 is larger than the reference value 512, the toner supply mechanism 302 causes the shutter member 304 to be in an open state, and starts a toner supply (Yes in Step S802). At this point in time, the toner supply amount calculation section 602 calculates, as described above, the toner supply amount based on the number of drive pulses entered into the drive motor 312 (the amount of the toner supplied by the toner supply mechanism 302 from the toner case 301 to the developing device 205). As described above, the calculated toner supply amount is accumulated up to the arrival of the timing for calculating the correction toner supply amount (Step S803, No in Step S804, Step S801, and Yes in Step S802).

In addition, in the present embodiment, the toner supply mechanism 302 enters the obtained output value of the toner sensor 410 into the toner supply amount calculation section 602. It should be noted that when the output value of the toner sensor 410 is not more than the reference value, the toner supply mechanism 302 keeps the shutter member 304 in a closed state (No in Step S802).

After the processing in Step S803, when the number of printed pages reaches the previously designated number or when all the printing is completed, and when the timing for calculating the correction toner supply amount arrives (Yes in Step S804), the toner supply amount calculation section 602 obtains the cumulative toner supply amount Sacc from the cumulative toner supply amount holding section 603 (Step S805). In addition, the toner supply amount calculation section 602 calculates the toner supply amount Scal (Step S806).

According to the present embodiment, the toner supply amount Scal during the predetermined time PT is calculated according to Formula (1) below. It should be noted that in Formula (1), S1 is the motion quantity of the toner supply mechanism 302 during the predetermined time PT, that is, the cumulative value of the toner supply amount based on the number of drive pulses entered into the drive motor 312 during the predetermined time PT. The predetermined time PT is a period of time from the previous reset up to the arrival of timing for calculating the correction toner supply amount. In addition, X is a correction value of the toner supply amount based on the output value of the toner sensor 410, and is expressed by X=K×(the reference value of the toner sensor 410−an average of the output values of the toner sensor 410).

$$Scal=B\times S1+X \quad (1)$$

Here, a factor B is a factor determined according to the toner remaining amount in the toner case 301. It should be noted that the amount of remaining toner in the toner case 301 can easily be calculated by subtracting, from an initial toner amount, the cumulative toner supply amount Sacc that is obtained from the cumulative toner supply amount holding section 603. The initial toner amount is the amount of toner stored in the toner case 301 at the time of installation of the toner container 230.

As the amount of toner remaining in the toner case 301 decreases, the amount of toner dropping from the supply port 303 onto the developing device 205 along with the rotation of the toner conveyance member 311 tends to decrease, as compared to the case of the toner remaining amount in the initial state. The factor B is assumed as a variable factor (0<B≤1) that is changed according to the amount of toner remaining in the toner case 301 so as to reflect the tendency in calculating the toner supply amount. In the present embodiment, although not particularly limited, the factor B is previously registered with the toner supply amount calculation section 602.

FIG. 9 is a diagram showing an example of a factor table held by the toner supply amount calculation section 602. As shown in FIG. 9, a factor table 901 stores the toner remaining amount and the value of factor B in association with each other. In the example in FIG. 9, where the toner remaining amount is larger than 80% and not more than 100%, B=1. This shows that if the toner remaining amount is closer to the initial state, the toner drops from the supply port 303 onto the developing device 205 by just the amount calculated in proportion to the number of rotations of the toner conveyance member 311. In addition, where the toner remaining amount is larger than 0% and not more than 5%, B=0.5.

This shows that if the toner remaining amount is extremely small, the toner drops onto the developing device 205 only by the amount that is approximately half the toner remaining amount closer to the initial state even if the number of rotations of the toner conveyance member 311 is the same. It should be noted that in the example shown in FIG. 9, 0.5<B≤1, but the factor B can be appropriately selected from the range of 0<B≤1.

During a time from the previous reset up to the arrival of the timing for calculating the correction toner supply amount, as long as the output value of the toner sensor 410 is reliably maintained to the reference value, there is no problem in assuming the toner supply amount Scal as a product of the factor B by the cumulative value S1 of the toner supply amount that is based on the number of drive pulses. However, in practice, there is a possibility of occurrence of cases where the output value of the toner sensor 410 is not more than the reference value (in case of a large amount of toner) or where the output value is not less than the reference value (in case of a small amount of toner).

Thus, according to the present embodiment, as shown in Formula (1), the toner supply amount calculation section 602 calculates an average of the output values of the toner sensor 410 that have been obtained during a period of time from the previous reset to the arrival of the timing for calculating the correction toner supply amount (that is, during the predetermined time PT). Then, the toner supply amount calculation section 602 calculates a difference between the reference value of the toner sensor 410 and the average of the output values of the toner sensor 410. Then, the toner supply amount Scal is calculated by adding or subtracting the amount of toner corresponding to the difference (the correction value X described above) to or from B×S1. It should be noted that the factor K in the correction value X is a factor for converting the difference between the toner sensor reference value and the average of the output values of the toner sensor into the toner amount.

FIG. 10 is a diagram showing a relationship between the output value of the toner sensor of the toner supply mechanism 302, the number of rotations, and the toner supply amount. As shown in Table 1001 in FIG. 10, the toner supply mechanism 302 in the present embodiment causes the toner conveyance member 311 to make 0.7 rotation each time the output value of the toner sensor 410 increases from the reference value by "25". In terms of calculation, this 0.7 rotation corresponds to the amount of toner 16 mg. From this relationship, the present embodiment assumes: factor K=16/25.

It should be noted that the values of the factor B and the factor K as described above may be experimentally obtained using a real machine.

The toner supply amount calculation section 602, which has calculated the toner supply amount Scal as above, enters the calculated toner supply amount Scal into the correction toner supply amount calculation section 604. At this time, the correction toner supply amount calculation section 604 instructs the toner supply amount calculation section 602 to reset the cumulative value. As shown in FIG. 8, according to the instruction, the toner supply amount calculation section 602 resets the cumulative value of the toner supply amount (Step S807).

It should be noted that when the timing for calculating the correction toner supply amount is set to the time of completion of the printing, the procedure is finished (Yes in Step S808). In addition, when the timing for calculating the correction toner supply amount is set to the time when the number of printed pages reaches a predetermined number, the procedure up to the completion of the printing is repeated (No in Step S808, and Step S801).

On the other hand, return to FIG. 7, the correction toner supply amount calculation section 604 calculates the correction toner supply amount Scor during the predetermined time PT, using: the toner supply amount Scal during the predetermined time PT, which has been obtained from the toner supply amount calculation section 602; the toner consumption amount Cdot during the predetermined time PT, which has been obtained from the dot-count calculation section 601; and the cumulative toner supply amount Sacc obtained from the cumulative toner supply amount holding section 603 (Step S707). The correction toner supply amount Scor is calculated according to Formula (2) below.

$$Scor=Cdot-(Cdot-Scal)\times A \quad (2)$$

Here, the factor A is a factor determined according to the amount of toner remaining in the toner case 301. It should be noted that the amount of toner remaining in the toner case 301 can easily be calculated by subtracting, from an initial toner amount, the cumulative toner supply amount Sacc obtained from the cumulative toner supply amount holding section 603. The initial toner amount is an amount of toner stored in the toner case 301 at the time of installation of the toner container 230.

As described above, as the amount of toner remaining in the toner case 301 decreases, the amount of toner dropping from the supply port 303 onto the developing device 205 along with the rotation of the toner conveyance member 311 tends to decrease, as compared to the case of the toner remaining amount in the initial state. In other words, in the case of the toner remaining amount in the initial state, there is a comparatively small gap between the real toner supply amount and the toner consumption amount that is based on the dot count. However, as the amount of toner remaining in the toner case 301 decreases, the gap between the real toner supply amount and the toner consumption amount based on the dot count increases.

The factor A is a factor for reflecting this tendency. Accordingly, the factor A is set as a variable factor ($0<A\leq1$) that is changed according to the toner remaining amount. By changing the factor A, it is possible to change the degree of influence of the toner supply amount Scal calculated by the toner supply amount calculation section 602, on the correction toner supply amount. In other words, it is possible to change, according to the amount of toner remaining in the toner case 301, the degree of influence of the toner supply amount calculated by the toner supply amount calculation section 602, on the calculation of the correction toner supply amount. As a result, it is possible to grasp the amount of toner remaining in the toner case 301 more accurately than by the general dot-count method. In the present embodiment, although not particularly limited to the following, the factor A is previously registered with the correction toner supply amount calculation section 604.

FIG. 11 is a diagram showing an example of the factor table held by the correction toner supply amount calculation section 604. As shown in FIG. 11, in the factor table 1101, the toner remaining amount and the value of the factor A are stored in association with each other. The example in FIG. 11 shows: if the toner remaining amount is larger than 60% and not more than 100%, A=0.5. If the toner remaining amount is larger than 10% and not more than 60%, A=0.8. If the toner remaining amount is larger than 0% and not more than 10%, A=1.

For example, if A=1, according to Formula (2), the correction toner supply amount Scor=the toner supply amount Scal. In other words, according to the present embodiment, the influence of the toner supply amount Scal on the calculation of the correction toner supply amount Scor is increased as the toner remaining amount decreases, thus making it possible to accurately grasp the amount of toner remaining in the toner case 301, which has been difficult to achieve only by calculating the toner consumption amount by a general dot-count method. In addition, it is possible to grasp, more accurately, the amount of toner remaining in the toner case 301 even if the toner remaining amount is large.

It should be noted that the value of the factor A as described above may be experimentally obtained using a real machine. In addition, in the example shown in FIG. 11, $0.5\leq A\leq1$, but the factor A can be appropriately selected from a range of $0<A\leq1$.

As described above, the correction toner supply amount calculation section 604, after calculating the correction toner supply amount Scor, notifies the cumulative toner supply amount updating section 605 of the correction toner supply amount Scor that has been calculated. As shown in FIG. 7, the cumulative toner supply amount updating section 605, which has received the notice, adds the correction toner supply amount Scor that has been notified and the cumulative toner supply amount Sacc held by the cumulative toner supply amount holding section 603, and stores a value resulting from the addition as a new cumulative toner supply amount in the cumulative toner supply amount holding section 603 (Step S708). In addition, at this time, the correction toner supply amount calculation section 604 instructs the dot-count calculation section 601 to reset the cumulative value. According to the instruction, the dot-count calculation section 601 resets the cumulative value of the toner consumption amount (Step S709).

It should be noted that when the timing for calculating the correction toner supply amount as described above is the time of completion of the printing, the procedure is finished (Yes in Step S710). In addition, when the timing for calculating the correction toner supply amount is the time when the number of printed pages reaches a predetermined number, the above procedure up to the completion of the printing is repeated (No in Step S710, and Step S701).

As described above, in the multifunction peripheral 100, the amount of toner used in the toner case 301 (the correction toner supply amount Scor) is calculated, based on the toner consumption amount Cdot calculated by the dot-count method and the toner supply amount Scal that is separately calculated. As a result, it is possible to calculate, more accurately, the amount of the toner supplied from the toner case 301 to the developing device 205 than by the general dot-count method. In addition, the multifunction peripheral 100 reflects the dependency of the toner remaining amount in the calculation of the correction toner supply amount, thus synergistically producing an advantageous effect of accurately grasping the toner remaining amount. Thus, by appropriately fitting the factors A, B, and K, it is possible to grasp the amount of toner remaining in the toner case 301 more accurately than by the general dot-count method. As a result, this allows the user to effectively use a toner resource as well as replacing the toner case 301 with appropriate timing without causing decrease in productivity of the multifunction peripheral 100 (image forming apparatus).

In addition, in the toner remaining amount control as described above, it is not necessary to provide a new sensor and so on in the toner case 301 and so on. Thus, it is also possible to realize the toner remaining amount control easily and at low cost by, for example, adding, through change in software and so on, the toner supply amount calculation section, the correction toner supply amount calculation section, the cumulative toner supply amount updating section, and so on to an existing multifunction peripheral that calculates the toner consumption amount by the dot-count method.

It should be noted that the embodiment described above is not to limit the technical scope of the present disclosure, and other than the above, various variations and applications are possible within the scope of the present disclosure. For example, in the embodiment described above, an example of an application to the multifunction peripheral 100 of what is called a tandem system has been illustrated, but the present embodiment may also be applied to a multifunction peripheral of a rotary system. In addition, the present embodiment can also be applied not only to the color multifunction peripheral 100 but also to a monochrome multifunction peripheral.

Furthermore, the toner supplying mechanism 302 is not limited to the configuration above, either, and any arbitrary configuration may be adopted.

In addition, in the description above, as particularly preferred forms, the correction toner supply amount is calculated according to Formula (1) and Formula (2), but the present disclosure is not limited to use of these formulae. As described above, when the amount of the toner in the toner case 301 decreases, the toner supply amount, which is obtained by calculation based on the operation of the toner supply mechanism 302, can reflect the real toner consumption amount more accurately than the toner consumption amount calculated by the dot-count method. Thus, when the configuration allows, at least, calculating the correction toner supply amount using the toner supply amount when the amount of the toner decreases, it is possible to grasp the toner remaining amount more accurately than by the general dot-count method. In this case, the method for obtaining the toner supply amount is not particularly limited.

Furthermore, in the flowcharts shown in FIG. 7 and FIG. 8, the sequence of each step is appropriately changeable within the scope in which an equivalent advantageous effect can be produced.

In addition, in the embodiment described above, the present disclosure has been embodied as a digital multifunction peripheral 100, but the present disclosure, not only limited to the digital multifunction peripheral 100, can also be applied to an arbitrary image forming apparatus such as a facsimile machine and a copier.

According to the present disclosure, it is possible to grasp the amount of toner remaining in the toner case 301 more accurately than by the general dot-count method, and the present disclosure is effective as an image forming apparatus and a toner remaining amount control method.

What is claimed is:

1. An image forming apparatus, comprising:

a toner case for storing toner;

a developing device configured to attach toner to an electrostatic latent image formed on an image carrier, so as to form a toner image on the image carrier;

a toner sensor configured to detect an amount of the toner in the developing device;

a toner supply mechanism configured to supply the developing device with the toner stored in the toner case, based on an output value of the toner sensor;

a dot-count calculation section configured to count, based on image data, the number of dots printed on a transfer target, and calculate, based on a count value, a toner consumption amount that is an amount of the toner consumed in the developing device;

a toner supply amount calculation section configured to calculate a toner supply amount that is an amount of the toner supplied by the toner supply mechanism from the toner case to the developing device;

a cumulative toner supply amount holding section configured to hold a cumulative toner supply amount that is a cumulative amount of the toner supplied from a point when use of the toner in the toner case is started;

a correction toner supply amount calculation section configured to calculate a correction toner supply amount that is a used amount of the toner in the toner case, based on the toner consumption amount and the toner supply amount, the toner consumption amount being calculated by the dot-count calculation section, and the toner supply amount being calculated by the toner supply amount calculation section; and a cumulative toner supply amount updating section configured to add the correction toner supply amount and the cumulative toner supply amount, and store a value resulting from the addition as a new cumulative toner supply amount in the cumulative toner supply amount holding section, the correction toner supply amount being calculated by the correction toner supply amount calculation section, and the cumulative toner supply amount being held by the cumulative toner supply amount holding section.

2. An apparatus according to claim 1, wherein the correction toner supply amount calculation section calculates the correction toner supply amount during a predetermined time, based on the toner consumption amount, the toner supply amount, and a toner remaining amount, the toner consumption amount being calculated by the dot-count calculation section during the predetermined time, and the toner supply amount being calculated by the toner supply amount calculation section during the predetermined time, and the toner remaining amount is an amount of the toner remaining in the toner case, the amount being calculated from the cumulative toner supply amount held by the cumulative toner supply amount holding section.

3. An apparatus according to claim 2, wherein the toner supply amount calculation section calculates the toner supply amount during the predetermined time, based on a motion quantity of the toner supply mechanism during the predetermined time and the output value of the toner sensor.

4. An apparatus according to claim 3, wherein the correction toner supply amount calculation section calculates the correction toner supply amount according to a formula below:

$$Scor=Cdot-(Cdot-Scal)\times A, \text{ wherein}$$

Scor: the correction toner supply amount during the predetermined time,

Cdot: the toner consumption amount during the predetermined time,

Scal: the toner supply amount during the predetermined time, and

A ($0<A\leq 1$): a factor determined according to the toner remaining amount.

5. An apparatus according to claim 4, wherein the toner supply amount calculation section calculates the toner supply amount according to a formula below:

$$Scal=B\times S1+X, \text{ wherein}$$

Scal: the toner supply amount during the predetermined time,

B ($0<B\leq 1$): a factor determined according to the toner remaining amount,

S1: the toner supply amount based on the motion quantity of the toner supply mechanism during the predetermined time, and X: a correction value based on the output value of the toner sensor.

6. An apparatus according to claim 5, wherein the toner supply mechanism includes a drive motor, and the motion quantity of the toner supply mechanism is the number of drive pulses entered into the drive motor.

7. An apparatus according to claim 6, wherein the correction value X is calculated according to a formula below:

*X=K×(a reference value of the toner sensor−an average of the output value of the toner sensor during the predetermined time), wherein*

K: a factor for converting a difference between the reference value and the average into an amount of the toner.

8. An apparatus according to claim 7, wherein the predetermined time is a period of time from previous timing for calculating the correction toner supply amount up to an arrival of timing for calculating the correction toner supply amount, and the timing for calculating the correction toner supply amount is one of: when, in one printing job, printing of a predetermined number of pages is completed, and when all printing included in the one printing job is completed.

* * * * *